United States Patent [19]

Morse et al.

[11] 3,941,083

[45] Mar. 2, 1976

[54] FLAG POLE

[76] Inventors: Samuel F. Morse, c/o George Spector; George Spector, both of 3615 Woolworth Bldg., 233 Broadway, New York, N.Y. 10007

[22] Filed: Jan. 14, 1975

[21] Appl. No.: 540,829

[52] U.S. Cl. ..... 116/173

[51] Int. Cl.[2] ..... G09F 17/00

[58] Field of Search ..... 116/173, 174, 175; 246/125, 127, 292

[56] References Cited

UNITED STATES PATENTS

| | | | |
|---|---|---|---|
| 1,102,413 | 7/1914 | Jensen | 116/173 |
| 1,482,036 | 1/1924 | Schablow | 116/173 |
| 1,613,979 | 1/1927 | Bolander | 116/173 |
| 3,792,680 | 2/1974 | Allen | 116/173 |

FOREIGN PATENTS OR APPLICATIONS

| | | | |
|---|---|---|---|
| 40,655 | 12/1956 | Germany | 116/173 |

*Primary Examiner*—Richard C. Queisser
*Assistant Examiner*—Marcus S. Rasco

[57] ABSTRACT

A flag pole that is balanced about pivot bearings of a stationary base so that the flag pole can be effortlessly tilted down into a horizontal position so that the flag can be removed or attached; the pole being made of interfitting sections, and the uppermost section loosely supporting a series of flag rings for selected ones to have the flat supported therefrom.

1 Claim, 5 Drawing Figures

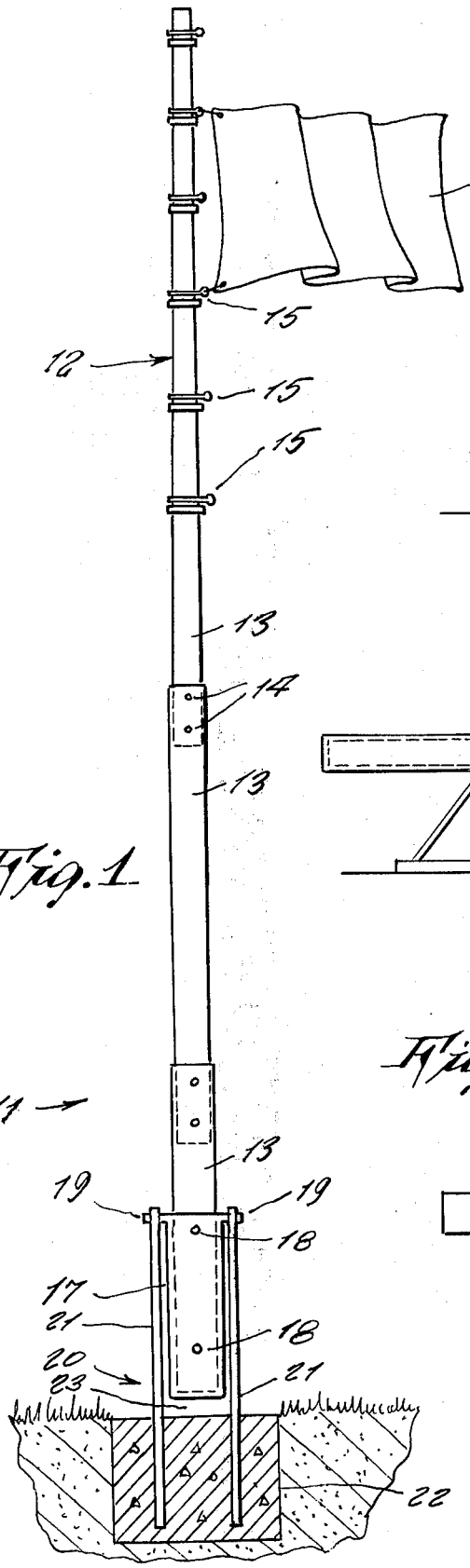
Fig. 1
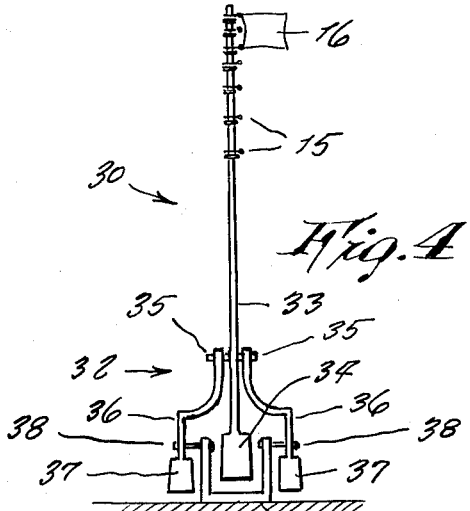
Fig. 4
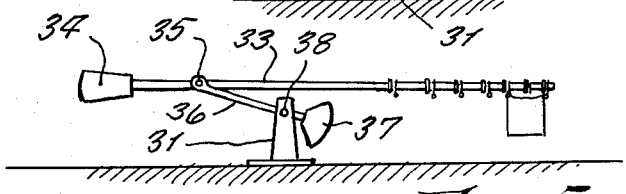
Fig. 5
Fig. 3
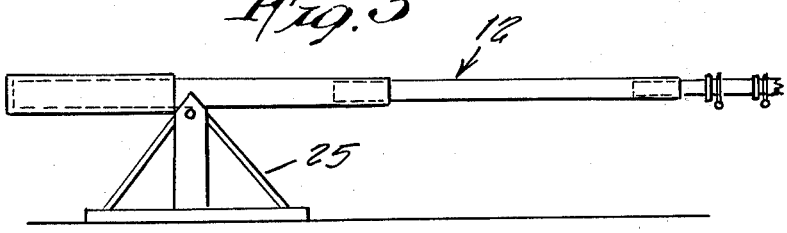
Fig. 2
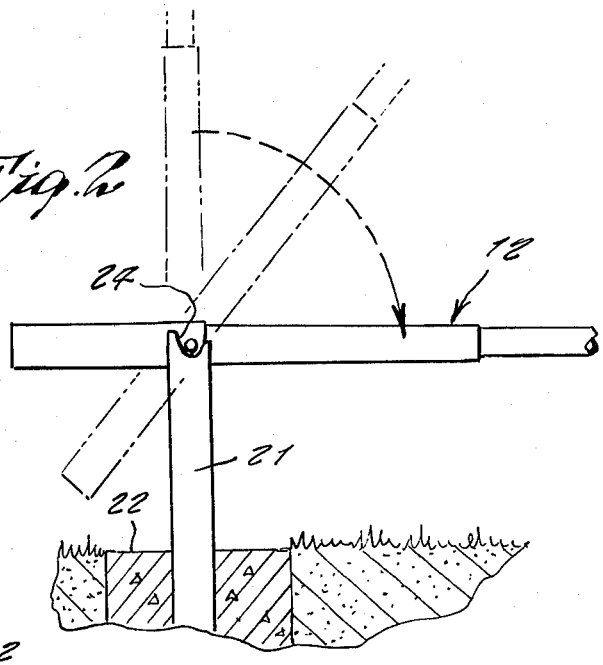

FLAG POLE

This invention relates generally to flag poles.

A principle object of the present invention is to provide a flag pole which is supported in a balanced condition upon a transverse shaft of a stationary base so that the flag pole can be pivoted down to the ground so a person can thus reach the upper end of the post easily so to tie a flag thereto so remove the flag therefrom.

Another object is to provide a flag pole made up in sections that can be readily assembled together and secured together either permanently by welding or temporarily by screws.

Yet another object is to provide a balanced flag pole that can be made in various sizes and which can be installed upon grounds in front of a house or other suitable place.

Other objects are to provide a balanced flag pole which is simple in design, inexpensive to manufacture, rugged in construction, easy to use and efficient in operation These and other objects will be readily evident upon a study of the following specification and the accompanying drawing wherein:

FIG. 1 is a side view of the flag pole in vertically upstanding position.

FIG. 2 is a front view thereof with the pole pivoted down to horizontal position.

FIG. 3 is a side view thereof shown with an above ground base.

FIG. 4 is a view of a modified design of the invention in which a set of counterbalances on levers allow the flagpole to be maintained upright as shown.

FIG. 5 is a front view of the modified design of FIG. 4 shown with flag pole pivoted down in horizontal position, and wherein the lever and counterbalance arrangement brings the flag closer to the base so a person does not have to walk as far to the flag from the base after pivoting it down.

Referring now to the drawing in detail, and more particularly to FIGS. 1 to 3 at this time, the reference numeral 11 represents a balanced flag pole according to the present invention wherein there is pole 12 comprised of a set of interfitting metal pipe sections 13 which as shown in FIG. 1, are secured together with screws 14. Alternately, they may be welded together. The uppermost section has a set of rings 15 loosely fitted therearound, and a flag 16 is attached to any of this rings. The loose rings allows the rings to rotate about the post so the flag flys to leeward straight therefrom.

The lowermost section of the pole is slide fitted into a counterweight socket 17 and is either welded thereto or secured by screws 18; the socket being integral with pivot pins 19 on diametrically opposite sides thereof.

In FIGS. 1 and 2, the flag pole 11 is supported upon a stationary base 20 consisting of a pair of parallel, vertical, spaced apart bars 21 which at their lower ends are imbedded within a concrete block 22 within a ground; the upper surface of the block being level with the ground. The upper ends of the bars have a notch 24 in which the pivot pins 19 rest when the flag pole is positioned in a space 23 between the bars. It is to be noted that the relatively short length of the pole that forms the socket end is very bulky so that its weight is very slightly more than the long end of the pole so that the pole normally assumes a vertical position as shown in FIG. 1, and wherein with only slight physical effort by a person, the pole can then be tilted to the ground as shown in FIG. 2, so to remove a flag.

In FIG. 3, the same design flag pole 12 is mounted upon a stationary base 25 that is above ground.

In FIGS. 4 and 5, a modified design of balanced flag pole 30 consists of any form of stationary base 31 and a flag pole assembly 32 that include a flag pole 33 having rings 15 and flag 16 at one end and an immense counterweight 34 at its other end so to approximately balance the pole about pivot pins 35 located relatively close to the counterweight. The pivot pins are each supported at one end of a pair of levers 36 having immense counterweights 37 at their other ends so to approximately balance the levers about pivot pins 38 located near the counterweights, and supported upon the base 31.

In this form of the invention, when the flag pole 33 is pivoted to the ground the flag is brown closer to the base so that a person needs not walk as far from the base to reach it. In this construction, the counterweight 37 approximately balances the entire remainder of the flag pole assembly so that the longer arms of the levers swing the lower end of the glag pole away from the base, thus bringing the flag closer to it.

Thus a modified design is presented.

While various changes may be made in the detail construction, it is understood that such changes will be within the spirit and scope of the present invention, as is defined by the appended claims.

What is claimed is:

1. A flag pole assembly comprising a flag pole having an upper end with flag rings and a lower end with a counterweight, in combination with a pair of similar levers pivotally secured to each side of the pole by means of a pivot pin above said counterweight, each lever having a similar counter weight secured to the lower end thereof, including a pair of pivot pins each secured similarly to each of said levers, in further combination with a U-shaped base having a pair of spaced vertical flanges equi-spaced laterally from the first said counterweight, wherein said pair of spivot pins are aligned and mounted in said flanges and wherein the said second counterwights are equi-spaced from said flanges remote from the first said counterweight.

* * * * *